US007721954B1

(12) United States Patent
Karamian et al.

(10) Patent No.: US 7,721,954 B1
(45) Date of Patent: May 25, 2010

(54) COMBINATION WALLET AND MULTI-ACCOUNT LEDGER BALANCING SYSTEM FOR MONITORING A USER'S SPENDING HABITS IN REAL-TIME

(76) Inventors: Joseph Karamian, 1980 Fern La., Glendale, CA (US) 91208; Izela Karamian, 1980 Fern La., Glendale, CA (US) 91208

( * ) Notice: Subject to any disclaimer, the term of this patent is extended or adjusted under 35 U.S.C. 154(b) by 776 days.

(21) Appl. No.: 11/207,696

(22) Filed: Aug. 22, 2005

(51) Int. Cl.
*G06K 5/00* (2006.01)

(52) U.S. Cl. ..... 235/380; 235/486

(58) Field of Classification Search ..... 235/380, 235/382, 379, 486, 492, 487, 493
See application file for complete search history.

(56) References Cited

U.S. PATENT DOCUMENTS 4,719,453 A * 1/1988 Beck et al. ..... 340/568.7
4,724,527 A 2/1988 Nishimura et al.
4,916,434 A * 4/1990 McNeely ..... 340/568.7
D317,921 S 7/1991 Suzuki
5,034,724 A * 7/1991 Tone ..... 340/571
5,053,749 A * 10/1991 Weiss ..... 340/568.7
5,125,356 A * 6/1992 Galante ..... 116/200
5,221,838 A 6/1993 Gutman et al.
5,373,283 A * 12/1994 Maharshak ..... 340/568.7
5,790,027 A * 8/1998 Chern ..... 340/568.7
5,834,756 A 11/1998 Gutman et al.
5,872,844 A 2/1999 Yacobi
5,914,657 A * 6/1999 Chen ..... 340/568.7
6,184,788 B1 * 2/2001 Middlemiss et al. ..... 340/568.7
6,454,164 B1 * 9/2002 Wakabayashi et al. ..... 235/380
6,611,819 B1 8/2003 Oneda

* cited by examiner

*Primary Examiner*—Thien M Le

(57) ABSTRACT

A combination wallet and real-time account management system for monitoring a user's spending habits includes monolithically formed first and second sections adaptable between open and closed positions. The system further includes a mechanism for detecting the presence of a credit card and an audible mechanism for notifying a user when a credit card is removed from the wallet and not replaced within a predetermined time interval. An electronic mechanism for performing mathematical calculations is integrally situated within the wallet and non-removable therefrom. The first section includes a plurality of pockets sized and shaped for receiving and storing credit cards. Such pockets are spaced along the first section of the wallet. The second section includes a plurality of pockets sized and shaped for receiving and storing paper money and a personal checkbook.

13 Claims, 3 Drawing Sheets

COMBINATION WALLET AND MULTI-ACCOUNT LEDGER BALANCING SYSTEM FOR MONITORING A USER'S SPENDING HABITS IN REAL-TIME

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to money management systems and, more particularly, to a combination wallet and data management system for updating a user's debit/credit/cash accounts in real-time.

2. Prior Art

In today's world of financing and personal money management, convenience and time are extremely valuable commodities. Contemporary financial communication systems significantly improve accessibility to financial information and substantially facilitate financial transactions. However, a number of unfortunate limitations reduce the potential convenience and time efficiency for a user of these financial communication systems.

For example, an individual desiring to withdraw a sum of money from a bank account is usually required to physically commute to a banking facility or to an ATM to perform the financial transaction. Also, the individual is typically required to present a corresponding ATM financial card for identification. Consequently, a financial card for each financial institution must normally be carried on one's person at all times. Lastly, after the transaction is consummated, the information is typically maintained electronically at the banking facility and only a paper receipt is provided to the individual. Hence, at least one additional step is required for the individual to manually transfer the financial information (i.e., an update to a balance) to a financial log or diary (e.g., one normally included with a check book).

In a second example, to execute a purchase the individual normally surrenders some form of money (e.g., cash, check, or financial card) in exchange for goods or service. At the point of sale, the individual may present cash in exchange for a merchandise and receive a paper receipt for the transaction. In the case of a check transaction, an establishment may honor a check, usually after collecting the individual's personal information (e.g., a driver's license number, and a financial card number and expiration date), and complete the check purchase transaction as discussed earlier for the cash purchase transaction. Alternatively, by using a financial card (e.g., a credit card) a financial card transaction is substantially more complicated, as will be discussed below.

In the financial card transaction, the individual must usually select and present one of many financial cards that are necessarily carried on one's person. A point of sale (POS) terminal usually reads the financial card for financial information and additionally receives keyboard entry of a purchase price and associated information. The POS terminal then normally auto-dials a central financial computer to verify an identification code and an allowable credit limit. Upon approval, a balance at the central financial computer is updated accordingly, and the individual must normally confirm the transaction with a signature on a paper receipt, copies of which are divided among the individual, the establishment, and a central financial institution (e.g., MasterCard or Visa). A financial card transaction, therefore, allows the convenience of carrying minimal amounts of cash, however at the expense of a more complicated financial transaction and an additional processing fee for the financial service provided.

In the cash transaction, the individual normally receives a paper receipt and must perform additional steps to collect and record the financial information associated with the transaction. Usually, the individual manually transfers the financial information from the paper receipt to a financial log or diary.

Unfortunately, the check transaction additionally requires maintaining a paper trail for an extended time period. Typically, the check is honored by the establishment with little or no verification of the funds actually being available at a financial institution (e.g., a bank). Consequently, a paper trail must be maintained both by the individual and the establishment for at least until the financial institution honors the check (i.e., a check float period). This float period tends to be confusing, and with multiple checks written increases the probability of an error by the individual (i.e., typically in not maintaining proper account of a checkbook balance) leading to a check not honored by the financial institution (i.e., a check written on an overdrawn bank account). In such a case, the establishment must find the individual and retrieve the cash due (i.e., usually including a penalty fee).

In the case of the financial card transaction, the consummation of the financial transaction is normally more complicated and requires additional parties (e.g., the central financial institution) immediately in the transaction. The communication of financial information between the establishment, the individual, and the financial institution typically requires a number of steps to close the financial card transaction. Additionally, the financial information is only maintained electronically at the financial institution. Hence, a redundant paper trail is required to record and maintain the financial information with all parties to the financial card transaction.

Lastly, the individual making the purchase must manually transfer the financial information to a financial log or diary, thereby maintaining a personal account (i.e., a balance) of all transpired financial card transactions. Similar to the check transaction, previously discussed, an error by the individual while manually maintaining a balance in a financial log or diary for each financial card may result in exceeding a credit limit for a financial card, thereby including all associated consequences.

Moreover, this situation is particularly problematic when multiple financial cards or multiple checkbooks (i.e., with the same account identification information) are distributed between two or more individuals (e.g., between husband and wife, or between partners in a business). The concurrent use of the same financial card or checkbook account by many individuals may typically result in lost or untimely financial information maintained by at least one of the individuals, and consequently result in an exceeded financial card credit limit or a bounced check.

In a third example, an individual purchasing groceries at a supermarket is currently required to push a cart through many aisles stocked with grocery items. Selection of items and comparison of alternatives is performed manually, and usually while standing at a shelf in the supermarket. If a product is not present at the shelf, possibly due to stocking space limitations, the product is not considered. Additionally, the comparison of product attributes in executing a selection to initiate a purchase transaction (e.g., prices, nutritional content, etc.) must normally be performed manually by reading the product labels, the supermarket labels, and mentally calculating the differences between alternative products. Very little assistance is provided the individual in performing the purchase transaction, other than stocking the items on the supermarket shelves.

Lastly, the loaded shopping cart must usually be pushed around the entire supermarket and subsequently stand in line waiting for a cashier to tally up the total bill. After the cashier provides a total due, the individual consummates the purchase transaction by providing the proper monetary exchange for the groceries (e.g., cash, check, or financial card). The individual then faces all the similar limitations and hindrances presented in the second example above.

Accordingly, a need remains for a system that overcomes the above noted shortcomings. The present invention satisfies such a need by providing a combination wallet and real-time account management system for monitoring a user's spending habits. Such a wallet includes a personal finance and real-time account management system for monitoring a user's spending habits and an audible signal emitter to remind a user to replace a credit card and record a transaction. Such a wallet advantageously includes a plurality of pockets sized and shaped to hold credit cards, cash and a personal checkbook.

BRIEF SUMMARY OF THE INVENTION

In view of the foregoing background, it is therefore an object of the present invention to provide a combination wallet and real-time account management system for monitoring a user's spending habits. These and other objects, features, and advantages of the invention are provided by a system for reminding a user to replace debit/credit cards removed for purchases and to update their checking account balance in real-time.

The primary scope of the present invention is to budget and control a person's spending habits in a variety of industries including checking account transactions, cash transactions as well as credit/debit card transactions. For example, when a check is written, the present invention asks the owner of the bank account, against which the check was written, for the check number, date/time and the amount of the check. Such data is uploaded into a primary database and manipulated by a preprogrammed logic algorithm to provide a real-time running balance on the checking account's ledger.

The present invention preferably includes a plurality of controls associated with a plurality of credit/debit cards such as VISA, MASTERCARD and department store cards, for example. A monthly ledger balance is maintained and updated in real-time for each credit/debit card account wherein the end of a billing cycle is designated by the credit/debit card company. Such a billing cycle end date is programmed by the user into the database of the present invention so that a variety of different billing cycles can be updated and monitored in real-time.

In operation, when a user removes a credit card from the wallet, the system automatically displays the credit card information and prompts the user to enter the amount charged to the card so that a real-time account balance can be displayed. A low voltage audio signal emitter may be employed to periodically remind the user to update the latest transactions information so that the user can quickly and accurately access real-time data transactions without having to revert to a paper statement or PC. A summary of charged transactions is also provided wherein a series of lists are displayed for illustrating the user's spending habits as well as assisting the user to manage their budget on a daily and real-time basis.

The system includes a foldable wallet preferably formed from flexible material and including monolithically formed first and second sections. The first and second sections have substantially planar top and bottom portions and the wallet is adaptable between open and closed positions such that the first and second sections lay parallel to a horizontal plane when adapted to the closed position.

The system further includes a mechanism for detecting the presence of a credit card and an audible mechanism for notifying a user when a credit card is removed from the wallet and not replaced within a predetermined time interval. The system further includes an electronic mechanism for performing mathematical calculations that is integrally situated within the wallet and non-removable therefrom. The electronic mechanism includes a database for digitally storing monetary information about a user's ledger balance and a power supply source internally housed within the wallet.

The first section includes a plurality of pockets sized and shaped for receiving and storing credit cards. Such pockets are preferably spaced along the first section of the wallet. The second section includes a plurality of pockets sized and preferably shaped for receiving and storing paper money and a personal checkbook.

The detecting mechanism includes a microprocessor and a plurality of sensors electrically coupled to the microprocessor for detecting the presence of a credit card. Such sensors are positioned within the cavity of each pocket and seated adjacent to an inner wall of each of the pockets such that the sensors become directly abutted against a magnetic strip on a credit card. Each of the sensors generates and transmits a unique output signal corresponding to a location of one of the pockets respectively. The microprocessor receives the output signal and executes a programmed logic control algorithm for identifying a missing one of the credit cards.

The audible mechanism includes a sound emitting device and a timer circuit electrically mated to the microprocessor. The timer circuit generates and sends a control signal to the microprocessor after the predetermined time interval has lapsed. The microprocessor generates and transmits an audible signal to the sound emitting device for automatically notifying the user of the missing credit card.

The calculating mechanism includes a memory electrically coupled to the microprocessor and bearing software instructions for performing a series of steps. Such a series of steps includes (a) determining a beginning balance in a user's account; (b) adjusting the balance based upon a processed monetary transaction; and (c) providing an ending balance in the user's account after the monetary transaction has been completed.

An LCD display screen is electrically mated to the microprocessor. The microprocessor generates and transmits an output signal to the display screen for visually identifying the ending balance. The calculating mechanism further includes a user interface including a plurality of alphanumeric controls responsive to a user input for allowing the user to manually update the ending balance.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
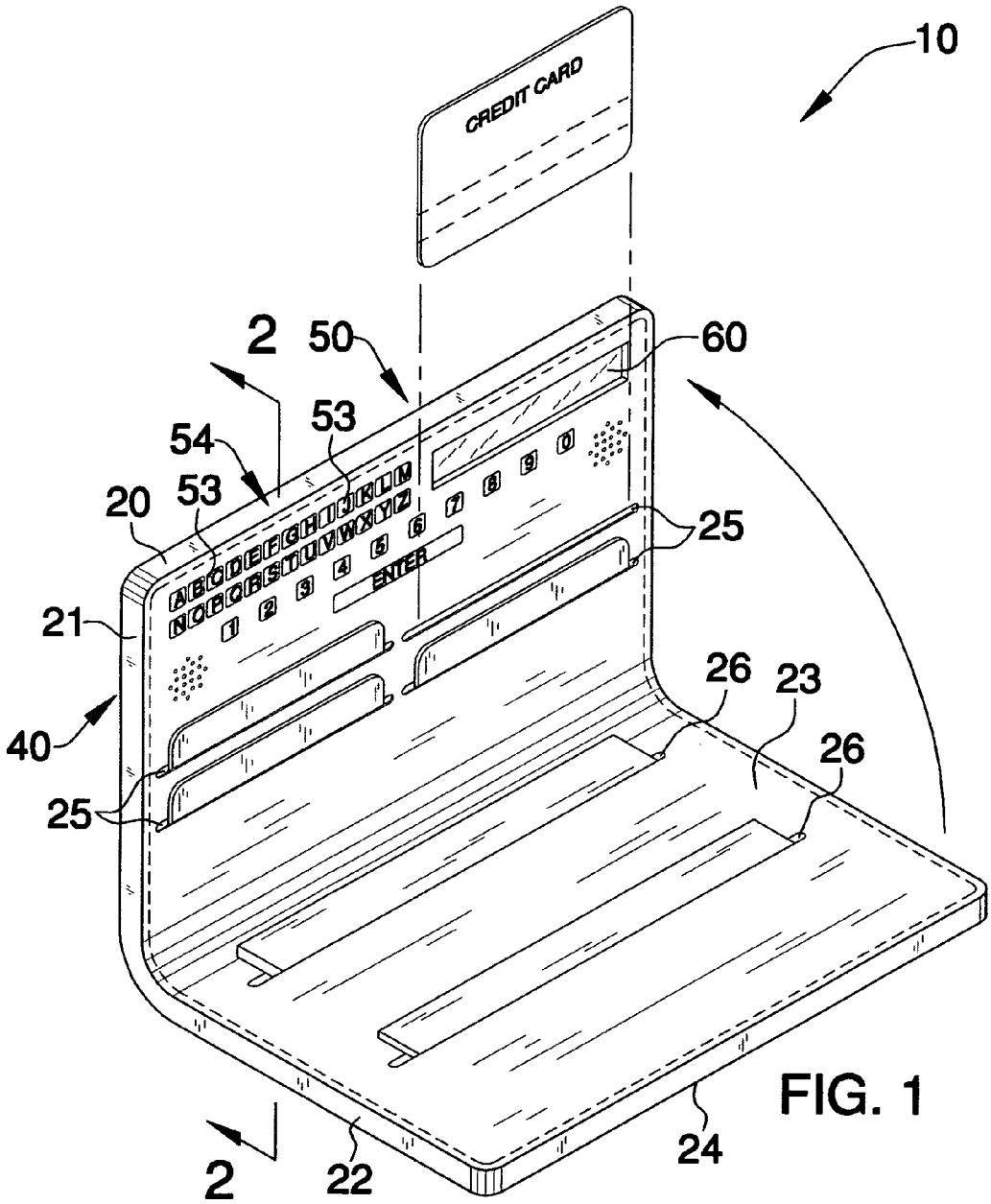
FIG. 1 is a perspective view showing a combination wallet and real-time account management system for monitoring a user's spending habits, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide a combination wallet and real-time account management system for monitoring a user's spending habits. It should be understood that the system 10 may be used to store many different objects and execute different types of real-time money management algorithms and should not be limited to storing only credit cards.

Figure 3:
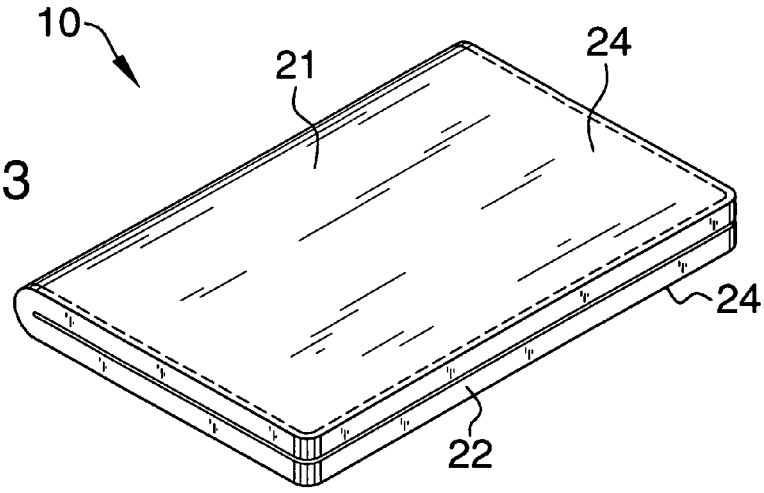
FIG. 3 is a perspective view showing the system at the closed position.

Initially referring to FIG. 1, the system 10 includes a foldable wallet 20 formed from flexible material, such as leather, for example, and including monolithically formed first 21 and second 22 sections. Of course, the wallet 20 may be formed from other flexible materials such as nylon, synthetic leather, cloth, and rubber, as well known in the industry. The first 21 and second 22 sections have substantially planar top 23 and bottom 24 portions and the wallet 20 is adaptable between open and closed positions such that the first 21 and second 22 sections lay parallel to a horizontal plane when adapted to the closed position, as shown in FIG. 3. Such positioning is critical to the system 10 so that it can be easily stored and transported to remote locations by a user, enabling such user to always have access to money.

Figure 4:
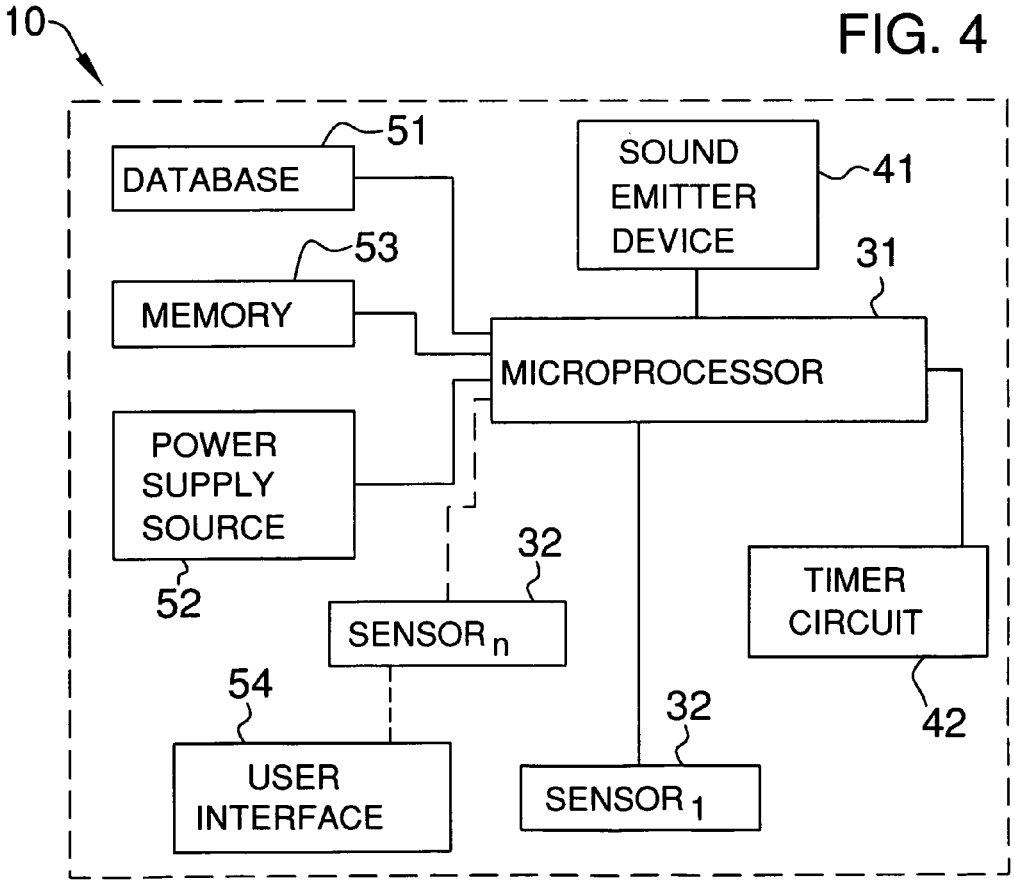
FIG. 4 is a schematic diagram of the system shown in FIG. 1.

Referring to FIGS. 1 and 4, the system 10 further includes a mechanism 30 for detecting the presence of a credit card and an audible mechanism 40 for notifying a user when a credit card is removed from the wallet 20 and not replaced within a predetermined time interval. Such a detecting mechanism 30 is critical for aiding a user in remembering to replace removed cards after use. Today's high incidence of credit card and identity theft make such detecting 30 and audible 40 mechanisms vital to safeguarding one's assets. The system 10 further includes an electronic mechanism 50 for performing mathematical calculations that is integrally situated within the wallet 20 and non-removable therefrom. Just as important as safeguarding one's assets, is maintaining accountability thereof. The electronic mechanism 50 is critical to maintaining an accurate balance of one's personal checking and savings accounts, especially when credit and debit cards are frequently used. The electronic mechanism 50 includes a database 51 for digitally storing monetary information about a user's ledger balance and a power supply source 52 internally housed within the wallet 20. Such a power source is preferably rechargeable and may include batteries of varying size and shape, as is obvious to one having ordinary skill in the art.

Figure 2:
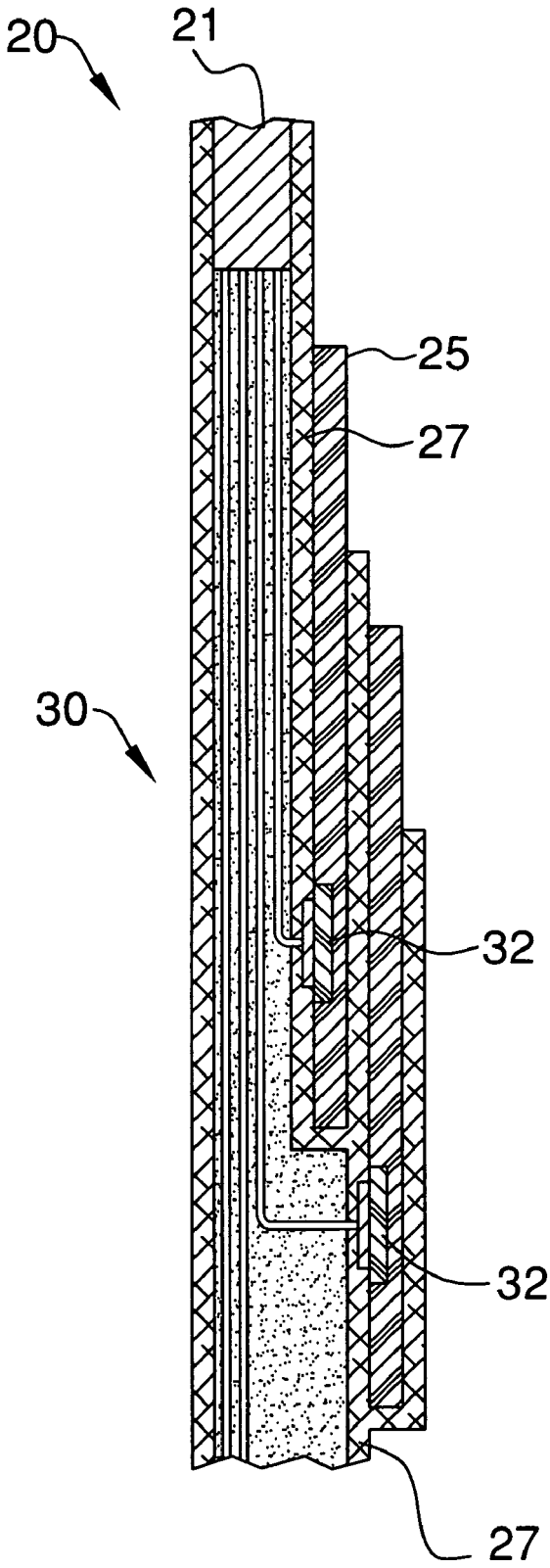
FIG. 2 is a cross-sectional view of the system shown in FIG. 1, taken along line 2-2.

Referring to FIGS. 1 and 2, the first section 21 includes a plurality of pockets 25 sized and shaped for receiving and storing credit cards. Such pockets 25 are spaced along the first section 21 of the wallet 20. The second section 22 includes a plurality of pockets 26 sized and shaped for receiving and storing paper money and a personal checkbook. The pockets 25, 26 securely maintain the items stored therein while allowing for fast and easy access by a user when needed.

Referring to FIGS. 1 and 4, the detecting mechanism 30 includes a microprocessor 31 and a plurality of sensors 32 electrically coupled to the microprocessor 31 for detecting the presence of a credit card. Such sensors 32 are positioned within the cavity of each pocket 25, 26 and seated adjacent to an inner wall 27 of each of the pockets 25,26 such that the sensors 32 become directly abutted against a magnetic strip on a credit card. Of course, such sensors 32 may also be used to detect the presence of cash, checkbooks, and other objects, as is obvious to one having ordinary skill in the art. Each of the sensors 32 generates and transmits a unique output signal corresponding to a location of one of the pockets 25, 26 respectively. The microprocessor 31 receives the output signal and executes a programmed logic control algorithm for identifying a missing one of the credit cards.

Referring to FIGS. 1 and 4, the audible mechanism 40 includes a sound emitting device 41 and a timer circuit 42 electrically mated to the microprocessor 31. The timer circuit 42 generates and sends a control signal to the microprocessor 31 after the predetermined time interval has lapsed. The microprocessor 31 generates and transmits an audible signal to the sound emitting device 41 for automatically notifying the user of the missing credit card. Such a signal is essential for reminding a user to replace removed credit cards, thus aiding a user in locating a lost or misplaced card prior to, or shortly after, leaving the premises.

Referring to FIG. 4, the electronic mechanism 50 further includes a memory 53 electrically coupled to the microprocessor 31 and bearing software instructions for performing a series of steps. Such a series of steps includes (a) determining a beginning balance in a user's account; (b) adjusting the balance based upon a processed monetary transaction; and (c) providing an ending balance in the user's account after the monetary transaction has been completed. The steps are important in maintaining an accurate and up to date balance of available funds so a user can make informed decisions regarding their finances.

Referring to FIGS. 1 and 4, an LCD display screen 60 is electrically mated to the microprocessor 31. The microprocessor 31 generates and transmits an output signal to the display screen 60 for visually identifying the ending balance. Such an LCD screen 60 is critical for notifying a user as to the amount of funds available, or for verifying entries input via the user interface (described herein below). The electronic mechanism 50 further includes a user interface 54 including a plurality of alphanumeric controls 53 responsive to a user input for allowing the user to manually update the ending balance. Such a user interface 54 conveniently allows a user to quickly and easily input their transactional information so their account balances can be updated, thereby maintaining an accurate balance and reducing the possibility of bank overdrafts.

The system 10 advantageously maintains a running total of expenditures for a predetermined time interval, such as a week, month or year, at all times. Such a total is instantly accessible by a user so that they may determine the level of their expenditures and adjust their spending accordingly, as well as provide their tax adviser or accountant with vital and up to date information.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combination wallet and data management system for reminding a user to replace credit cards removed for purchases and to update their debit/credit/cash account balances as well as balance account ledgers during a monthly cycle, said system comprising:

a foldable wallet formed from flexible material and including monolithically formed first and second sections, said first and second sections having substantially planar top and bottom portions, said wallet being adaptable between open and closed positions such that said first and second sections lay parallel to a horizontal plane when adapted to the closed position;

means for detecting the presence of a credit card;

audible means for notifying a user when a credit card is removed from said wallet and not replaced within a predetermined time interval; and electronic means for performing mathematical calculations, said electronic means being integrally situated within said wallet and non-removable therefrom;

wherein said detecting means comprises a microprocessor, and a plurality of sensors electrically coupled to said microprocessor and for detecting the presence of a credit card, said sensors being positioned within the cavity of each said pocket and seated adjacent to an inner wall of each said pockets such that said sensors become directly abutted against a magnetic strip on a credit card, each said sensors generating and transmitting a unique output signal corresponding to a location of one said pockets respectively, said microprocessor receiving said output signal and executing a programmed logic control algorithm for identifying a missing one of the credit cards.

2. The system of claim 1, wherein said first section comprises:

a plurality of pockets sized and shaped for receiving and storing credit cards, said pockets being spaced along said first section of said wallet.

3. The system of claim 1, wherein said second section comprises: a plurality of pockets sized and shaped for receiving and storing paper money and a personal checkbook.

4. The system of claim 1, wherein said audible means comprises:

a sound emitting device electrically mated to said microprocessor; and a timer circuit electrically mated to said microprocessor;

wherein said timer circuit generates and sends a control signal to said microprocessor after the predetermined time interval has lapsed, said microprocessor generating and transmitting an audible signal to said sound emitting device for automatically notifying the user of the missing credit card.

5. The system of claim 1, wherein said calculating means comprises:

a memory bearing software instructions for performing a series of steps, said memory being electrically coupled to said microprocessor;

wherein the series of steps comprise determining a beginning balance in a user's account, adjusting the balance based upon a processed monetary transaction, and providing an ending balance in the user's account after the monetary transaction has been completed;

an LCD display screen electrically mated to said microprocessor, said microprocessor generating and transmitting an output signal to said display screen for visually identifying the ending balance; and a user interface comprising a plurality of alphanumeric controls responsive to a user input for allowing the user to manually update the ending balance.

6. A combination wallet and real-time account management system for monitoring a user's spending habits , said system comprising:

a foldable wallet formed from flexible material and including monolithically formed first and second sections, said first and second sections having substantially planar top and bottom portions, said wallet being adaptable between open and closed positions such that said first and second sections lay parallel to a horizontal plane when adapted to the closed position;

means for detecting the presence of a credit card;

audible means for notifying a user when a credit card is removed from said wallet and not replaced within a predetermined time interval; and electronic means for performing mathematical calculations, said electronic means being integrally situated within said wallet and non-removable therefrom, said electronic means comprising: a database for digitally storing monetary information about a user's ledger balance;

wherein said detecting means comprises a microprocessor, and a plurality of sensors electrically coupled to said microprocessor and for detecting the presence of a credit card, said sensors being positioned within the cavity of each said pocket and seated adjacent to an inner wall of each said pockets such that said sensors become directly abutted against a magnetic strip on a credit card, each said sensors generating and transmitting a unique output signal corresponding to a location of one said pockets respectively, said microprocessor receiving said output signal and executing a programmed logic control algorithm for identifying a missing one of the credit cards.

7. The system of claim 6, wherein said first section comprises:

a plurality of pockets sized and shaped for receiving and storing credit cards, said pockets being spaced along said first section of said wallet.

8. The system of claim 6, wherein said second section comprises: a plurality of pockets sized and shaped for receiving and storing paper money and a personal checkbook.

9. The system of claim 6, wherein said audible means comprises:

a sound emitting device electrically mated to said microprocessor; and a timer circuit electrically mated to said microprocessor;

wherein said timer circuit generates and sends a control signal to said microprocessor after the predetermined time interval has lapsed, said microprocessor generating and transmitting an audible signal to said sound emitting device for automatically notifying the user of the missing credit card.

10. The system of claim 6, wherein said calculating means comprises:

a memory bearing software instructions for performing a series of steps, said memory being electrically coupled to said microprocessor;

wherein the series of steps comprise determining a beginning balance in a user's account, adjusting the balance based upon a processed monetary transaction, and providing an ending balance in the user's account after the monetary transaction has been completed;

an LCD display screen electrically mated to said microprocessor, said microprocessor generating and transmitting an output signal to said display screen for visually identifying the ending balance; and a user interface comprising a plurality of alphanumeric controls responsive to a user input for allowing the user to manually update the ending balance.

11. A combination wallet and real-time account management system for monitoring a user's spending habits and for reminding a user to replace debit/credit cards removed for purchases and to update their checking/debit/credit card account balance, said system comprising:

a foldable wallet formed from flexible material and including monolithically formed first and second sections, said first and second sections having substantially planar top and bottom portions, said wallet being adaptable between open and closed positions such that said first and second sections lay parallel to a horizontal plane when adapted to the closed position;

means for detecting the presence of a credit card;

audible means for notifying a user when a credit card is removed from said wallet and not replaced within a predetermined time interval; and electronic means for performing mathematical calculations, said electronic means being integrally situated within said wallet and non-removable therefrom, said electronic means comprising: a database for digitally storing monetary information about a user's ledger balance; and a power supply source internally housed within said wallet;

wherein said detecting means comprises a microprocessor, and a plurality of sensors electrically coupled directly to said microprocessor and for detecting the presence of a credit card, said sensors being positioned, within the cavity of each said pocket and seated adjacent to a inner wall of each said pockets such that said sensors become directly abutted against a magnetic strip on a credit card, each said sensors generating and transmitting a unique output signal corresponding to a location of one said pockets respectively, said microprocessor receiving said output signal and executing a programmed logic control algorithm for identifying a missing one of the credit cards;

wherein said audible means comprises a sound emitting device electrically mated directly to said microprocessor; and a timer circuit electrically mated directly to said microprocessor;

wherein said timer circuit generates and sends a control signal to said microprocessor after the predetermined time interval has lapsed, said microprocessor generating and transmitting an audible signal to said sound emitting device for automatically notifying the user of the missing credit card;

wherein said calculating means comprises a memory bearing software instructions for performing a series of steps, said memory being electrically coupled to said microprocessor;

wherein the series of steps comprise determining a beginning balance in a user's account, adjusting the balance based upon a processed monetary transaction, and providing an ending balance in the user's account after the monetary transaction has been completed;

an LCD display screen electrically mated directly to said microprocessor, said microprocessor generating and transmitting an output signal to said display screen for visually identifying the ending balance; and a user interface comprising a plurality of alphanumeric controls responsive to a user input for allowing the user to manually update the ending balance.

12. The system of claim 11, wherein said first section comprises;

a plurality of pockets sized and shaped for receiving and storing credit cards, said pockets being spaced along said first section of said wallet.

13. The system of claim 11, wherein said second section comprises: a plurality of pockets sized and shaped for receiving and storing paper money and a personal checkbook.

* * * * *